United States Patent [19]

Coviello et al.

[11] 4,028,769

[45] June 14, 1977

[54] APPARATUS FOR CLEANING CHIMNEY FLUES

[76] Inventors: Louis M. Coviello; Claire V. Coviello, both of R.R. No. 1, Cook, Minn. 55723

[22] Filed: Feb. 26, 1976

[21] Appl. No.: 661,803

[52] U.S. Cl. ..... 15/249; 15/243

[51] Int. Cl.[2] ..... F23J 3/00

[58] Field of Search ..... 15/162, 163, 242, 243, 15/249

[56] References Cited

UNITED STATES PATENTS

| | | | |
|---|---|---|---|
| 539,391 | 5/1895 | Newman | 15/242 X |
| 731,190 | 6/1903 | Kuhlman | 15/242 |
| 1,030,733 | 6/1912 | Johnston | 15/163 |
| 2,157,493 | 5/1939 | Miller et al. | 15/243 X |

FOREIGN PATENTS OR APPLICATIONS

| | | | |
|---|---|---|---|
| 464,295 | 1/1914 | France | 15/163 |
| 132,946 | 9/1951 | Sweden | 15/163 |

*Primary Examiner*—Edward L. Roberts
*Attorney, Agent, or Firm*—Clarence A. O'Brien; Harvey B. Jacobson

[57] ABSTRACT

An apparatus for cleaning chimney flues and the like having a pulley mounting structure which engages and is secured on the upper edge of a chimney flue together with a rope extending through the pulley with one end of said rope being operable from the ground level and the other end of the rope having a chimney cleaning device secured thereto. There are several embodiments of the mount for engaging the chimney flue as well as several embodiments for the chimney cleaning device. Basically the chimney cleaning device has an eyebolt secured to a metal plate with additional weights available when it is necessary to increase the over-all weight of said device. The metal plate is somewhat smaller than the inside dimensions of the flue and said metal plate has secured thereto a flexible plate which is slightly larger than the inside dimensions of the chimney flue. The flexible plate has means along the outer edges thereof for sweeping the inside of the chimney flue to remove creosote and carbon buildup therefrom. One such means consists of sawtooth edges along the outside edges of the flexible plate, another embodiment has metal plates secured along the outside edges with the flat portions of the plates being parallel to the flexible member, and another further embodiment has plates which are mounted with the flat portions of said plates perpendicular to the plane of the flexible member.

8 Claims, 12 Drawing Figures

APPARATUS FOR CLEANING CHIMNEY FLUES

BACKGROUND OF THE INVENTION

1. Field of the Invention

This invention relates generally to devices for cleaning chimney flues to remove soot, carbon, and creosote buildups therefrom.

2. Description of the Prior Art

Known prior art devices have various structures for sweeping or cleaning the inside of chimney flues, but these devices have a common problem in that they must be operated from atop the roof and/or chimney and may not easily be operated by a person on the ground.

Another common problem with known devices is that they become quickly clogged with the materials which are being removed from the inside of the chimney flues and then become partially inoperative. A further problem with the few known devices which may be operated from the ground outside the chimney is in the fact that they are not so constructed that the sweeping device may rest or be stored semi-permanently upon the outer chimney upper portion until the time for the next use thereof. For the average person, such as the conventional home owner, this presents a great disadvantage.

Known prior art patents which may be pertinent to this invention are as follows:

U.S. Pat. Nos.:

213,472—Mar. 18, 1879—Toyson 1,070,662—Aug. 19, 1913—Durand 1,725,980—Aug. 27, 1929—Fahrenbach et al.

1,785,950—May 20, 1930—Hunecke 2,756,451—July 31, 1956—Eklund.

None of these known prior art devices offer the new and unique features of the invention disclosed herein.

SUMMARY OF THE INVENTION

An object of the present invention is to provide an apparatus for cleaning chimney flues which is more convenient to operate and more efficient in operation than known existing type cleaners.

Another object of the present invention is to provide a chimney flue cleaning device which is easily operated externally of the chimney and from the ground level at the base of said chimney.

A further object of this invention is to provide a chimney flue cleaning device which has a semi-permanently mounted rope pulley support device for engagement with and mounting upon the upper top portion of said chimney flue being cleaned. This mount may be left on said chimney by the ordinary home owner with the chimney sweeping structure being semi-permanently stored at the top of the chimney after each use.

A still further object of this invention is to provide various chimney flue engaging mounts for supporting the pulley support structure of the chimney cleaning apparatus. These mounts permit use with chimneys of various type construction and add to the flexibility and adaptability of the over-all apparatus.

A still further object of this invention is to provide a chimney cleaning apparatus having various type devices for sweeping the inside of the chimney flue itself. These devices include a sawtooth edge structure, a flat parallel plate edge structure, and a perpendicular plate edge structure.

As envisioned by the above objects, the chimney sweeping apparatus has basically a flexible plate slightly larger than the inside of the chimney flue to be cleaned with the edges of said flexible plate having specific structure for cleaning soot, creosote, and carbon from the inside of said chimney flues. A primary embodiment has rectangular metal strips mounted perpendicular to the plane of the flexible member and on the outer edges thereof. Another embodiment envisions edges of the flexible cleaning member being of saw tooth shape. A still further embodiment envisions removable metal plates which are mounted with the flat surfaces of said metal plates in the same plane as that of the flexible member. All of these embodiments are supported from a smaller metal support secured to a screw eye with or without additional weight devices.

In order for the ordinary home owner to operate the cleaning apparatus of this invention from outside the chimney and preferably from the ground level or at the base of said chimney, a semi-permanent mount is also part of this apparatus with said mount being placed upon the upper portions of the chimney and left thereon for substantial portions of the year. Normally that would be during the heating season when the chimney would be in use. Obviously, during the summer months, the entire apparatus could be removed and stored away. Several different mounting structures are disclosed by this invention to add flexibility and adaptability to the over-all apparatus.

Another unique feature of this invention is in the fact that after the chimney is swept by the cleaning portion of the apparatus, the operator may easily remove the sweeping device from inside the chimney and cause same to rest upon the outer edge of the top portion of the chimney for semi-permanent storage thereof, ready for use when the next cleaning operation is scheduled or due. All of this is accomplished by the operator from outside the chimney and at the ground level or base thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
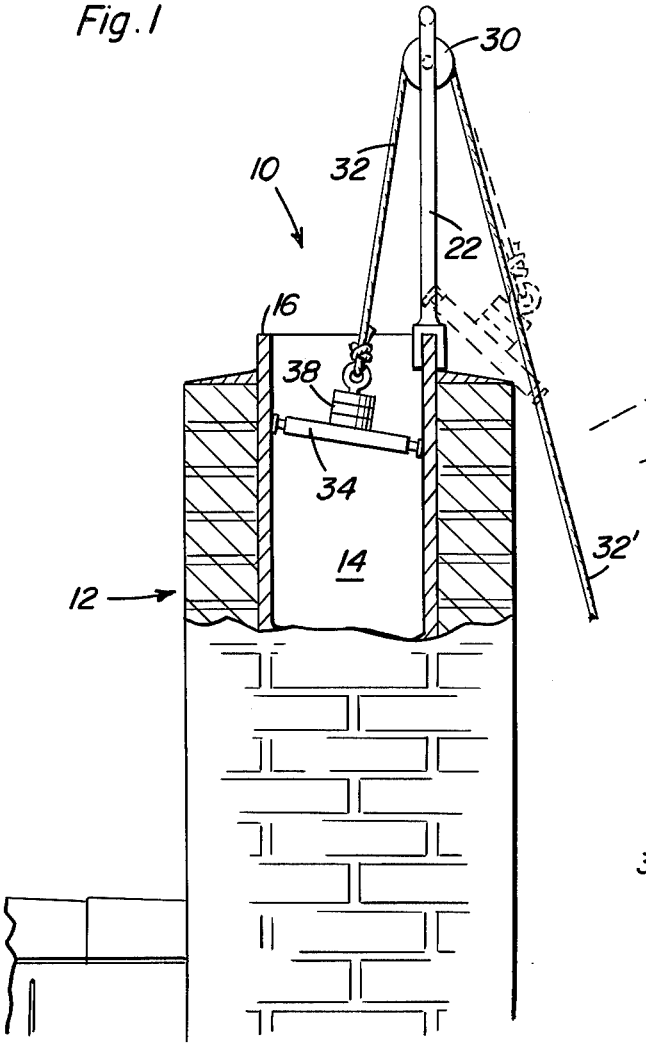
FIG. 1 is a perspective view of the apparatus of this invention as in normal use and, in dotted lines, as stored.
Figure 5:
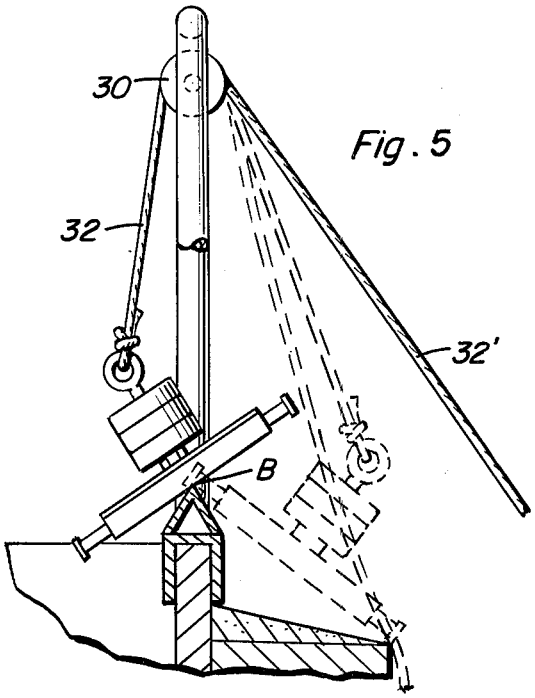
FIG. 5 is a view, partly in cross-section and partly in perspective, of the operation of the device in order to place the chimney sweep into a semi-permanent storage position.

Referring to FIG. 1 of the drawings, reference numeral 10 indicates the chimney cleaning apparatus of this invention as in use. A very important feature of this invention is in the fact that an operator or average home owner may semi-permanently mount the pulley mount structure upon the top of his chimney at the beginning of the heating season and then for the entire rest of the season clean his chimney at periodic intervals without the necessity of removing and storing the apparatus after each use. The apparatus of this invention is so designed that semi-permanent storage is made available by the over-all design of the apparatus itself. This design permits the chimney sweeping and cleaning portion of the apparatus to be stored at the top of the chimney after each use in a secure and positive manner. FIG. 5 shows an enlargement of this manner of storage.

Looking at FIG. 1, the chimney is generally referred to by reference numeral 12 and may as usual be made of suitable masonry material having an inner fire and heat resistant flue 14 with a top opening 16. a semi-permanent, portable and replaceable pulley mount is installed at the top opening 16 of the chimney flue at the beginning of each heating season. This mount, as shown in one embodiment in FIG. 2, includes a base member 20 made of channel iron having a flat top portion with two depending legs or flange portions which will permit the base portion to be placed over the upper chimney flue opening 16 in the manner shown in FIGS. 1 and 5 for secure and positive retention thereon. The channel legs are of sufficient depth that no additional fastening means normally is necessary to retain said base platform on the chimney flue. However, additional clamps, bolts, screws, etc., may be used if desired to clamp said platform to the flue liner. Such clamping means are not shown on the drawings, but are envisioned within the scope of this invention.

Figure 2:
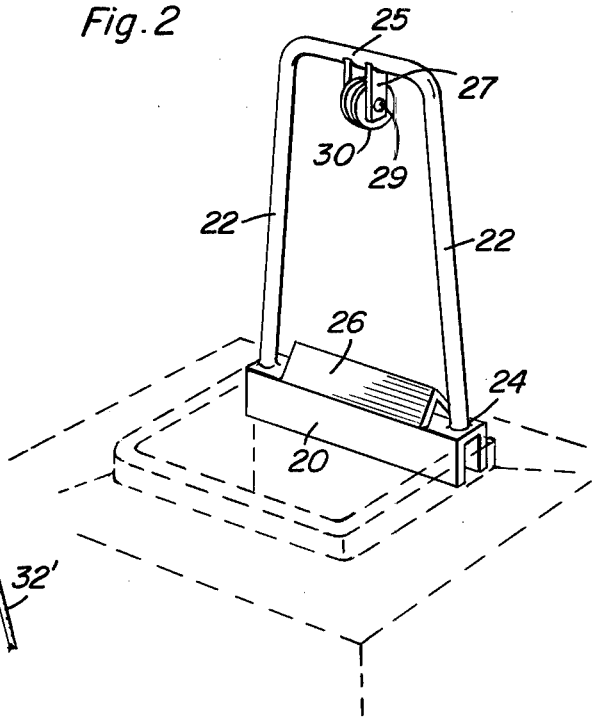
FIG. 2 is a perspective view of the pulley and bracket structure per se.

Looking at FIG. 2, the rest of the pulley support will be described. Located upon the base platform 20 are two uprights 22 of metal rod or the like having a horizontal portion 25 therebetween. The uprights may be fastened to the base plate by any suitable means, such as welding 24 shown. Depending from the center portion of the horizontal rod 25 are brackets 27, suitably drilled for a pin 29, or bolt, or the like, for rotatably supporting a cable or rope pulley 30. Another important part of this structure is the inverted channel iron 26 which is appropriately fastened to the base platform 20 by welding or other suitable means, not shown. This channel iron provides a sharp pointed or inverted V-type surface at the top of the base platform which is another very important feature of this invention.

Figure 3:
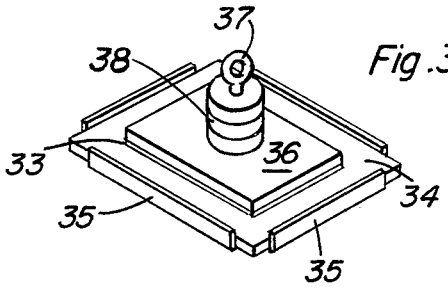
FIG. 3 is a perspective view of the chimney flue sweeping device per se of this invention.
Figure 8:
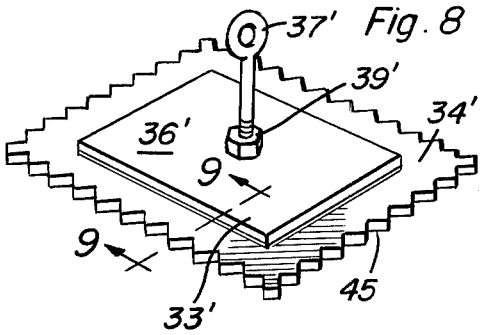
FIG. 8 is another embodiment of the chimney sweeping device per se as envisioned by this invention.
Figure 10:
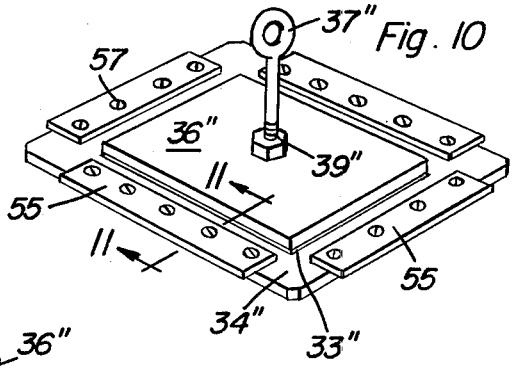
FIG. 10 is a view of another embodiment of the chimney sweeping device per se of this invention.

One of the embodiments of the chimney sweeping portion of the over-all apparatus is shown in FIG. 3. A plate 36 of rectangular, circular, or other desired configuration, but of a smaller circumference than the inside of the chimney flue 14 has attached to the center thereof an eyebolt 37. This eyebolt 37 may be fastened to the plate 36 by welding or other suitable means, but normally will be screwed into a tapped aperture in the center of said member 36 by suitable threads within the aperture and on the end of the eyebolt (see FIG. 4). FIGS. 8 and 10 also show this type of mounting. With a screw thread type fastening, the eyebolt 37 will be readily removable for replacement and removal of additional weights 38. With the screw thread type connection, a locking nut 39, 39′ or 39″, would be used to prevent the eyebolt from unscrewing in use. Fastened to the plate 36 by epoxy 33 or other suitable fastening means is another flexible plate 34. The flexible plate 34 is preferably just slightly larger than the inside of the chimney flue 14. Mounted on the outside edges of the flexible plate 34 and perpendicular thereto are horizontal rectangular strips 35 of metal or the like. These strips 35 may be attached to the flexible member 34 by an epoxy glue and the like.

Figure 4:
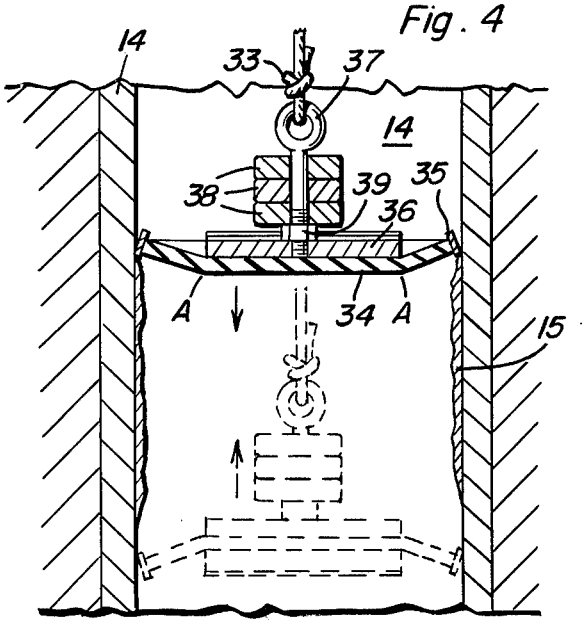
FIG. 4 is a cross-sectional view, in part, of the chimney cleaning apparatus of this invention as in use.

To complete the apparatus, a line, cable, chain or other flexible connecting and operating member 32 is tied or fastened at one end to the eyebolt 37, such as by the knot 33 shown in FIG. 4, and the other end passed over the pulley 30 and between the inner sides of the brackets 27 and the horizontal rod 25 to securely retain the rope in the pulley groove. The other end of the rope or line, which obviously must be of suitable length, is then dropped down the outside of the chimney to an operator therebelow. Normally, as envisioned by this invention, the operator will be on the ground or solid surface adjacent the base of the chimney on the outside thereof. All operation and control of the apparatus by the operator will take place from this point.

As seen in FIG. 4, when the chimney cleaning portion per se of the apparatus is dropped down within the chimney flue 14, the weight of the cleaning device itself together with any additional weights 38, will by gravity action cause the cleaner to drop down within the chimney flue. The flexible outer edges of the flexible plate 34 having the scrapper blades 35 on the edges thereof, and perpendicular thereto, will cause the flexible plate to bend and deform at approximately point A in FIG. 4 to give the scrapping edges 35 a proper angle to cut and scrap the carbon, creosote, and other residue buildup from the inner portion of said flue. After the cleaning structure is dropped to the bottom of the chimney, it then may be raised to the top again by pulling on the line 32. Upon starting to be pulled to the top, the outer flexible edges of the plate 34 will again deform in the opposite direction to again place the scrapper members 35 at the proper angle to the residue buildup for scrapping on the upswing. This action is shown in dotted lines in FIG. 4.

After the chimney has been cleaned, the operator will pull the line until the cleaning portion 34, 35, 36 clears the upper edge 16 of the chimney, at which point the angle of the line 32 to the eyebolt 37 will tend to swing the cleaner towards and over the pointed edge made by the member 26. By slacking the cable portion 32′ at the right instant, the cleaner device will swing over the outer edge of the chimney and the cleaning scrapper edge 35 closest to the chimney flue will catch at point B, seen in FIG. 5, on the pointed edge of member 26. This will tend to retain in the cleaning device semi-permanently on the upper portion of the chimney. The other outer edge of the cleaning device then may be semi-permanently retained by securing the portion of the line 32′ along the outside of the chimney by a suitable fastener or hook at the base level of said chimney. The line 32′ passing over the edge 35 of the cleaner will hold it against the chimney edge.

Figure 6:
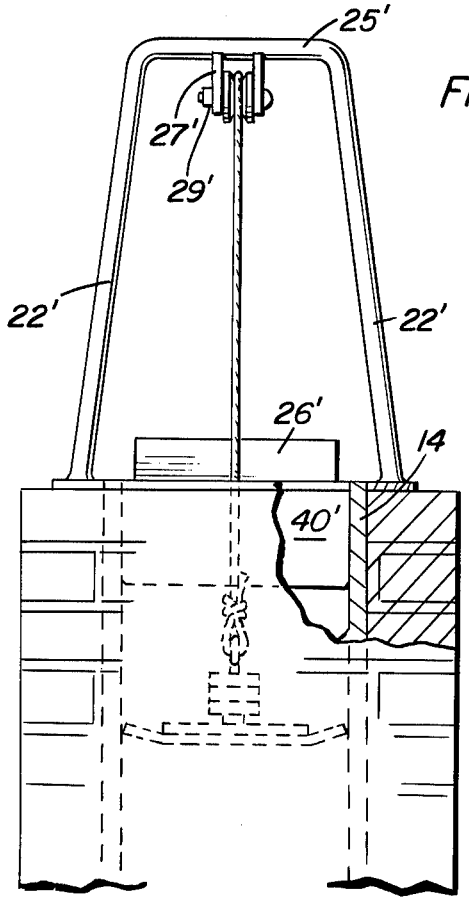
FIG. 6 is a partly perspective and partly cross-sectional view of a modified pulley and bracket mount.
Figure 7:
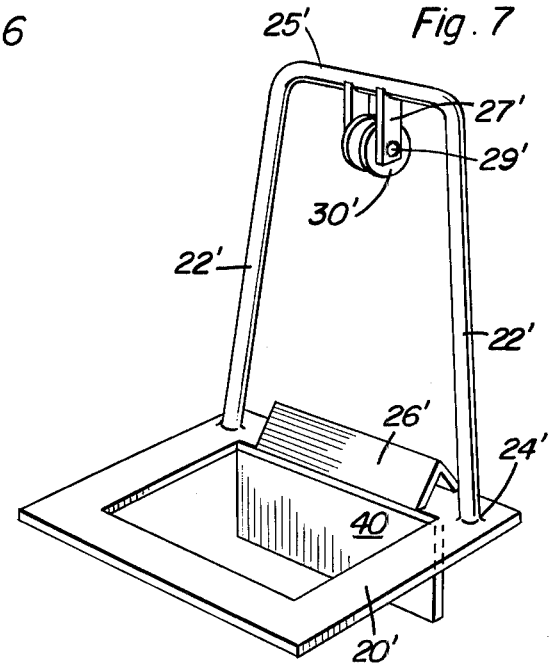
FIG. 7 is a perspective view of the modified pulley and bracket mount of FIG. 6.

FIGS. 6 and 7 show another embodiment of the device of this invention. All portions of the apparatus similar to those already described are referred to by the same reference numerals with a prime added thereto. The base platform 20′ has the uprights 22′ suitably welded thereto at 24′ and a horizontal pulley support portion 25′ with brackets 27′, pivot pin 29′ and pulley 30′ mounted therebetween. A deflecting and cleaner retention angle member 26′ is also provided. The new feature of this embodiment is in the mounting of said base platform on the top of said chimney. This version is intended for use with chimneys where the flue 14 is substantially even with the top outer edge of the chimney masonry construction. As seen in FIG. 6, with such a flue liner being even with the chimney, no projection such as 16 of FIG. 1 is present and, therefore, the double flanged member 20 of FIG. 2 would not hold. The base member 20′ of FIGS. 6 and 7 is provided with a depending flange 40 which will fit into the liner 14, as best seen in FIG. 6, and will semi-permanently secure in a positive manner the platform 20′ and the pulley support structure contained thereon. The operation of the rest of this structure will in this version be the same as that already described.

Figure 9:
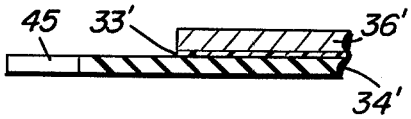
FIG. 9 is a side cross-sectional view taken generally along line 9—9 of FIG. 8.

A modified embodiment of the cleaning portion per se of the apparatus of this invention is shown in FIG. 8. The rigid base plate 36′ of suitable configuration is provided having an eyebolt 37′ secured thereto by a threaded connection and lock nut 39′ as already described above. A flexible cleaning plate 34′ is provided, again of suitable configuration, and of slightly larger size than the inside circumference of the chimney flues with which the device is intended to be used. The flexible member 34′ is fastened to the rigid plate 36′ by epoxy 33′ or other suitable fastening device. The outer edge of the flexible plate 34′ is provide with sawtooth serrations 45 therein for the purpose of performing the cleaning and scrapping action as described above for the FIG. 3 device. FIG. 9 shows a cross-sectional view of the left side portion of the device of FIG. 8.

Figure 11:
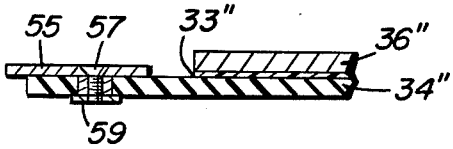
FIG. 11 is a side cross-sectional view taken generally along line 11—11 of FIG. 10.

FIGS. 10 and 11 shown another modified embodiment of the cleaning device of this invention. Here the basic components are again similar to those described above, but the flexible plate member 34″ has flat rectangular scrapper plates 55 mounted on the outer edges thereof in a plane parallel to the main plane of the flexible member. Suitable recessed fastening screws 57 and locking nut portions 59 (FIG. 11) are provided for holding these plates along the outer edges of the flexible member 34″. In operation, the cleaning device of FIGS. 10 and 11 will scrap and flex in a manner somewhat similar to that described for FIG. 4 above.

Figure 12:
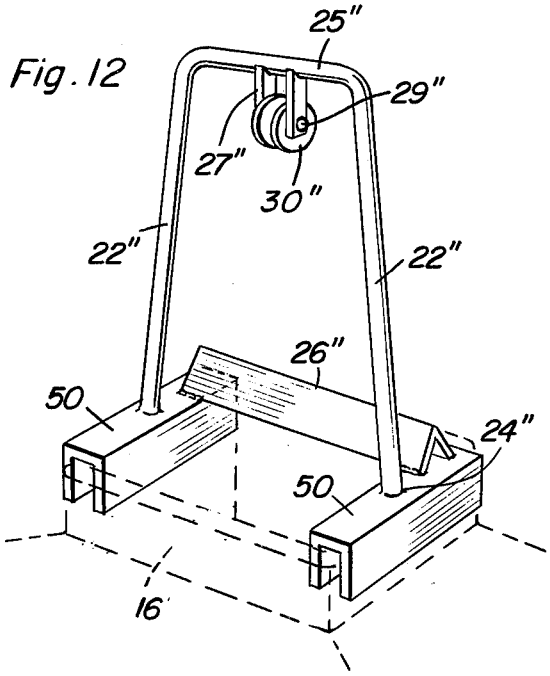
FIG. 12 is a further embodiment of the pulley and bracket mount of this invention.

FIG. 12 shows another embodiment of the pulley support and base platform structure. Similar reference numerals are again used with a double prime added thereto for indicating the particular component parts of the overall structure. Modification herein consists of the single base portion 20 of the other embodiments being replaced by two base portions, as shown in FIG. 12. Each of the lower ends of the rods 22″ is provided with a base portion 50 having depending channel flanges attached thereto. These channel flanges will rest upon opposite sides of a chimney flue opening 16 as previously described in FIG. 1. An inverted channel member 26″ is again provided for the purpose of outside storage of the cleaning portion per se of the apparatus.

From the above description and views, it can be seen how the apparatus of this invention will enable the ordinary home owner to semi-permanently mount the support and cleaning structure upon his chimney at the beginning of the heating season for quick and easy use throughout the entire heating season and eliminates the cleaning and storage problem normally encountered with known chimney cleaning devices. This feature in itself will be of great importance to the use of more and more fireplaces in this country.

With today's emphasis on the conservation of fuel and energy, more and more home owners are going to wood burning fireplaces, etc., to save and conserve fuel. It is a known fact that chimneys used with such fireplaces will accumulate large amounts of internal residue which if not periodically cleaned and removed constitute a real fire hazard. The apparatus of this invention will enable such fireplace users to quickly and easily clean their own chimneys on a periodic basis. The constant cleaning and installation and removal of such equipment being eliminated.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A chimney cleaning apparatus comprising: sweep means for movement up and down within the inside of the chimney for cleaning same, said sweep means including a flexible member shaped to provide a plurality of outer edges and being slightly larger than the inside of circumference of said chimney which will permit the outer edges of said flexible member to flex in an up and down direction while the sweep means is in operation, at least two or the outer edges of said flexible member being provided with rectangular strips fastened thereto, a removable platform mount for the top of the chimney, a flexible line connected to the sweep means and associated with the mount for operation by an operator on the base level outside of said chimney, additional means provided on the removable platform mount for enabling the operator to quickly and easily store the sweep means on the removable mount when the sweep means is not in use, the additional means on the removable platform mount for enabling the operator to store the cleaning sweep means consists of an inverted angle iron structure mounted on the top of the platform mount with the point upwardly to present a sharp pointed upwardly directed edge for catching and retaining the flexible member of the sweep means for storage purposes.

2. The structure as set forth in claim 1, wherein the removable mount includes a horizontal support frame having a pulley mounted thereupon for retaining and guiding the flexible operating line.

3. The structure as set forth in claim 2, wherein the horizontal support frame includes at least one depending flange for engagement with the inside portion of the upper chimney.

4. The structure as set forth in claim 1, wherein the base platform has at least two depending flange portions for engaging both the outer and inner top edges of said chimney flue.

5. The structure as set forth in claim 4, wherein the sweep means further includes a rigid non-flexible plate smaller than the outside circumference of the flexible member and securely attached to the center portion thereof for supporting a eyebolt from the center thereof for attachment to the line used for operating same.

6. The structure set forth in claim 5, wherein additional weight means are provided for said eyebolt structure which may be added or removed as necessary to alter the sweeping and cleaning action of said device.

7. A chimney cleaning apparatus comprising; first sweep means for movement up and down within the inside of the chimney for cleaning same, and second means for operating the said first sweep means from external of the chimney and from the ground or base level of said chimney on the outside thereof, the second means for operating the sweep means from external of said chimney includes a removable mount for the top of said chimney and a flexible line connected to the first means and associated with said mount for operation by an operator on the base level outside of said chimney, additional means is provided on the removable mount for enabling the operator to quickly and easily store the first sweep means on the removable mount throughout the heating season and when the sweep means is not in use, the removable mount including a horizontal support frame having a pulley mounted thereupon for retaining and guiding the flexible operating line, the horizontal support frame includes at least one depending flange for engagement with the inside portion of the upper chimney, the first sweep means for cleaning the inside of the chimney including a flexible member shaped to provide a plurality of outer edges and being slightly larger than the inside circumference of said chimney which will permit the outer edges of said flexible member to flex in an up and down direction while the sweep means is in operation, the outer edges of said flexible member are provided with specially shaped cleaning surfaces for increasing the cleaning action of said means, and the flexible line connected to the cleaning means and over the top mount comprising a line of rope-like material, and the speciallyshaped cleaning surfaces of said flexible member including rectangular strips fastened along at least two of the outer edges of the flexible member and perpendicular thereto.

8. A chimney cleaning apparatus comprising; first sweep means for movement up and down within the inside of the chimney for cleaning same, and second means for operating the said first sweep means from external of the chimney and from the ground or base level of said chimney on the outside thereof, the second means for operating the sweep means from external of said chimney includes a removable mount for the top of said chimney and a flexible line connected to the first means and associated with said mount for operation by an operator on the base level outside of said chimney, additional means is provided on the removable mount for enabling the operator to quickly and easily store the first sweep means on the removable mount throughout the heating season and when the sweep means is not in use, the removable mount including a horizontal support frame having a pulley mounted thereupon for retaining and guiding the flexible operating line, the horizontal support frame including at least one depending flange for engagement with the inside portion of the upper chimney, the first sweep means for cleaning the inside of the chimney including a flexible member shaped to provide a plurality of outer edges and being slightly larger than the inside circumference of said chimney which will permit the outer edges of said flexible member to flex in an up and down direction while the sweep means is in operation, the outer edges of said flexible member are provided with specially shaped cleaning surfaces for increasing the cleaning action of said means, and the flexible line connected to the cleaning means and over the top mount comprising a line of rope-like material, and the specially shaped cleaning surfaces of said flexible member including rectangular strips fastened along at least two of the outer edges of the flexible member and parallel thereto.

* * * * *